US011773665B1

(12) United States Patent
Jamison et al.

(10) Patent No.: US 11,773,665 B1
(45) Date of Patent: Oct. 3, 2023

(54) AGING CELL FOR DETERMINING PROPERTIES OF WELLBORE TREATMENT FLUID

(71) Applicant: Halliburton Energy Services, Inc., Houston, TX (US)

(72) Inventors: Dale E. Jamison, Humble, TX (US); Andrew Vos, Spring, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 18/295,909

(22) Filed: Apr. 5, 2023

(51) Int. Cl.

| | |
|---|---|
| ***E21B 21/08*** | (2006.01) |
| ***E21B 21/06*** | (2006.01) |
| ***E21B 49/08*** | (2006.01) |
| ***G01N 11/14*** | (2006.01) |

(52) U.S. Cl.
CPC ..... *E21B 21/08* (2013.01); *E21B 21/06* (2013.01)

(58) Field of Classification Search
CPC ..... E21B 21/06; E21B 21/08; E21B 49/08; G01N 11/14
See application file for complete search history.

(56) References Cited

U.S. PATENT DOCUMENTS

2018/0003607 A1* 1/2018 Gajji ..... E21B 21/14
2021/0372905 A1* 12/2021 LeBlanc ..... G01N 9/002

* cited by examiner

*Primary Examiner* — Dany E Akakpo
(74) *Attorney, Agent, or Firm* — Kilpatrick Townsend & Stockton LLP

(57) ABSTRACT

A system can be used to determine properties of a wellbore treatment fluid. The system can include a rotational system defining an axis of rotation and an aging cell. The aging cell can be positioned in the rotational system to rotate about the axis of rotation. The aging cell can include a housing, a sensor shaft, and a sensor. The housing can define an interior region of the aging cell to receive a wellbore treatment fluid. The sensor shaft can be at an angle from the axis of rotation and can be coupled to the interior region to transmit electronic signals about the wellbore treatment fluid. The sensor can be positioned on the sensor shaft to detect the electronic signals while the aging cell rotates about the axis of rotation, and the electronic signals can be used to determine the properties of the wellbore treatment fluid.

20 Claims, 5 Drawing Sheets

AGING CELL FOR DETERMINING PROPERTIES OF WELLBORE TREATMENT FLUID

TECHNICAL FIELD

The present disclosure relates generally to wellbore operations and, more particularly (although not necessarily exclusively), to aging cells for determining one or more properties of a wellbore treatment fluid.

BACKGROUND

A well system can include a wellbore, or other extraction system like a mine, etc., that can be formed in a subterranean formation for extracting produced hydrocarbons or other suitable resources. One or more wellbore operations, such as a wellbore drilling operation, a wellbore completion operation, a wellbore stimulation operation, a wellbore production operation, and the like, can use wellbore treatment fluid to enhance or otherwise facilitate the one or more wellbore operations. The wellbore treatment fluid may not have sufficient properties to perform the one or more wellbore operations. Measuring the properties of the wellbore treatment fluid can be difficult.

DETAILED DESCRIPTION

Figure 1:
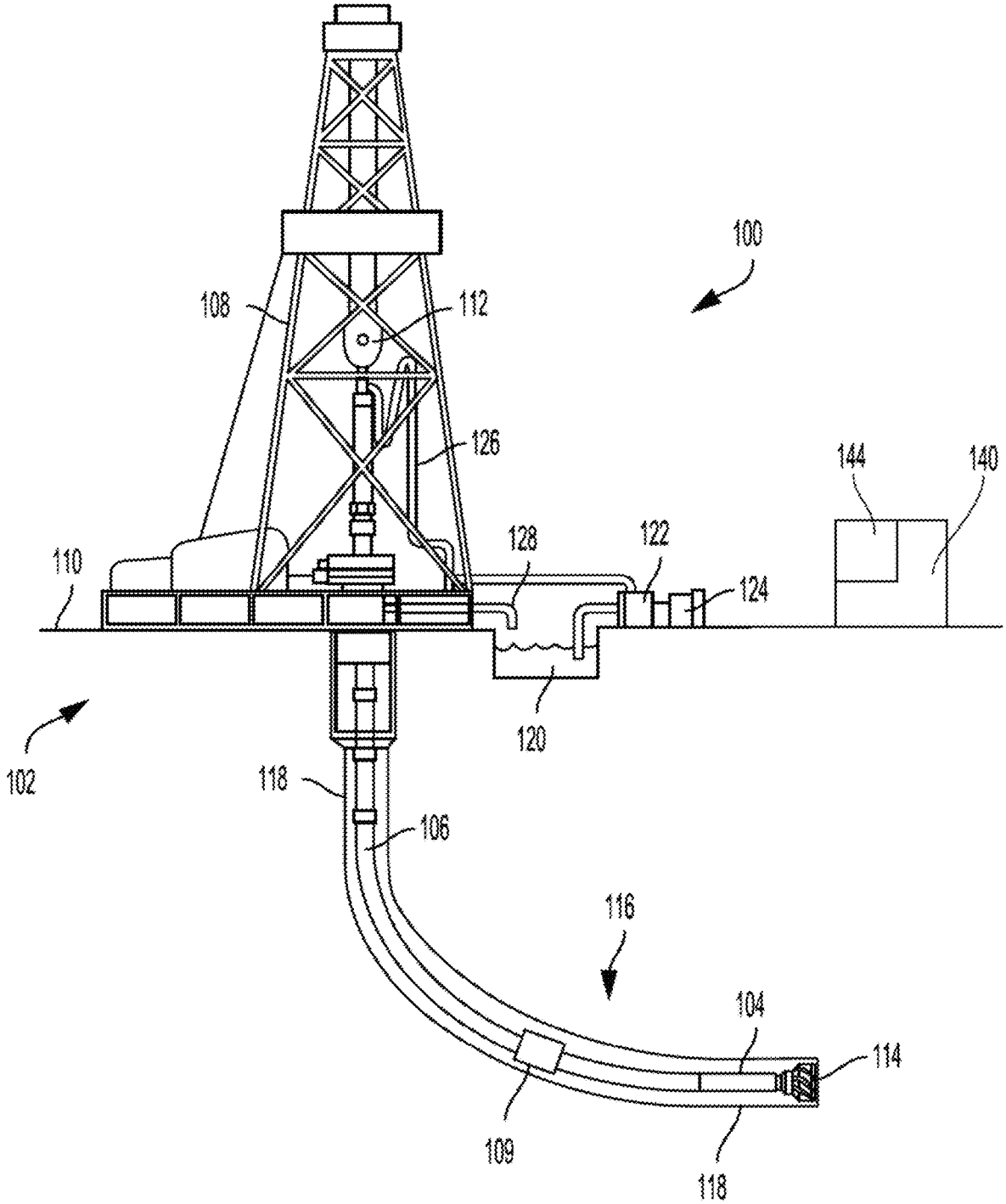
FIG. 1 is a schematic of a wellbore operation system that can use a wellbore treatment fluid according to examples of the present disclosure.

Certain aspects and features of the present disclosure relate to an aging cell that can be used to determine one or more properties of a wellbore treatment fluid. The wellbore treatment fluid can be or include a wellbore drilling fluid, a wellbore completion fluid, a wellbore stimulation fluid, or any other fluid that can be used in a wellbore. The aging cell can be or include a container that can be used to test the wellbore treatment fluid. For example, the wellbore treatment fluid can be positioned in the container of the aging cell, and one or more sensors included in the aging cell can be used to make measurements of the wellbore treatment fluid. The one or more sensors can be positioned on a sensor shaft that may be at an angle with respect to an axis of rotation of the aging cell. The one or more sensors can include a thermal conductivity sensor, a temperature sensor, or any other suitable sensor for measuring the one or more properties of the wellbore treatment fluid. The aging cell can be rotated, for example in a roller oven or other system that can facilitate rotation, about the axis of rotation, and the one or more sensors can detect signals that can be used to determine the one or more properties of the wellbore treatment fluid. In some examples, the one or more properties can be determined substantially contemporaneously with respect to detecting the signals. The one or more properties can include a fluid viscosity, a change in fluid viscosity, a thermal conductivity, a shear rate, and other suitable properties for the wellbore treatment fluid.

Testing wellbore treatment fluid, such as wellbore drilling fluid, wellbore completion fluid, and the like, can involve determining an upper temperature limit that the wellbore treatment fluid can withstand before rheological degradation leaves the wellbore treatment fluid unsuitable for use in the respective wellbore operation. For example, wellbore drilling fluid can be tested since poor rheological properties can cause cuttings transport and barite sag issues during a wellbore drilling operation, etc.

An aging cell can provide an indication of performance of the wellbore treatment fluid, for example continuously, while the wellbore treatment fluid is being tested. In some examples, the aging cell can use one or more sensors, such as a thermal conductivity sensor, a temperature sensor, and the like, that can be installed in the aging cell to detect viscosity changes while the aging cell is being used, for example at elevated temperatures. Additionally, the aging cell can allow faster (e.g., compared to other techniques and components for testing the wellbore treatment fluid) determination of a suitability of the wellbore treatment fluid and improved time-temperature data for determining efficacy of the wellbore treatment fluid.

In some examples, the aging cell can use a sensor, such as a thermal conductivity sensor, a temperature sensor, and the like, installed in the aging cell to detect viscosity changes while the aging cell is in a roller oven that can be used to test wellbore treatment fluid. If the sensor is positioned where the fluid flows past the sensor, then the difference in test results for the sensor can be related to the fluid viscosity, the thermal conductivity, the effective shear rate, and the like. In some examples, the specific heat of the fluid may be a constant. The rolling speed of the roller oven, and by extension the aging cell, can impact the shear rate and can result in a varying forced convection at a boundary of the sensor. The fluid viscosity can impact the rate at which pulsed energy is removed from the sensor, which can provide a measure of the fluid viscosity. To determine the fluid viscosity while the fluid is being tested, a library of similarly weighted wellbore treatment fluids may be used to scale the thermal response of the wellbore treatment fluid, the aging cell, the roller oven, or any combination thereof. In response to determining the initial viscous properties and the viscosity of a similar weighted wellbore treatment fluid, for example with and without rheological treatments, the sensor response may be used to approximate the viscosity changes in approximately real-time such as while the wellbore treatment fluid is in the aging cell.

Additionally, a set of sensors may be fixed within the same aging cell, for example at different locations, at different offset angles, and the like, which can be used to calculate viscous fluid effects at different effective shear rates approximately simultaneously. To accommodate simultaneous measurements at various shear rates, more than one sensor can be displaced at different offset angles.

In some examples, the aging cell can include a housing, a sensor shaft, and one or more sensors, and any other suitable components for the aging cell. The housing can define an interior region of the aging cell, and the interior region can be sized to receive the wellbore treatment fluid for testing. The sensor shaft can be coupled, for example electrically, communicatively, or the like, with a coupling device, such as a slip ring, of a roller oven in which the aging cell can be disposed. Additionally, the sensor shaft can have an offset angle with respect to an axis of rotation of the aging cell. The offset angle can be within a range of less than approximately one degree to less than approximately 90 degrees. In some examples, the aging cell can include a plurality of sensor shafts, and each sensor shaft of the plurality of sensor shafts can have a different offset angle. Additionally, each sensor shaft (e.g., whether there is one sensor shaft or more than one sensor shaft) may include one or more sensors, which may include a thermal conductivity sensor, a temperature sensor, other suitable sensors, or any combination thereof.

Illustrative examples are given to introduce the reader to the general subject matter discussed herein and are not intended to limit the scope of the disclosed concepts. The following sections describe various additional features and examples with reference to the drawings in which like numerals indicate like elements, and directional descriptions are used to describe the illustrative aspects, but, like the illustrative aspects, should not be used to limit the present disclosure.

FIG. 1 is a schematic of a wellbore operation system 100 that can use a wellbore treatment fluid according to examples of the present disclosure. While FIG. 1 illustrates a drilling operation system, any other wellbore operation system, such as a completion wellbore operation system, a stimulation wellbore operation system, a production wellbore operation system, and the like may use a wellbore treatment fluid that can be tested using the aging cell and related components described herein. The wellbore operation system 100 can include a wellbore 118 that can be used to extract hydrocarbons. The wellbore 118 may be created by drilling into a subterranean formation 102 using the wellbore operation system 100. The wellbore operation system 100 may drive a bottom hole assembly (BHA) 104 positioned or otherwise arranged at the bottom of a drill-string 106 extended into the subterranean formation 102 from a derrick 108 arranged at the surface 110. The derrick 108 can include a kelly 112 used to lower and raise the drill-string 106. The BHA 104 may include a drill bit 114 operatively coupled to a tool string 116, which may be moved axially within the wellbore 118 as attached to the drill-string 106. The tool string 116 may include one or more sensors 109 for determining conditions in the wellbore 118. The combination of any support structure (in this example, the derrick 108), any motors, electrical equipment, and support for the drill-string and tool string may be referred to herein as a drilling arrangement.

During operation, the drill bit 114 can penetrate the subterranean formation 102 to create the wellbore 118. The BHA 104 can provide control of the drill bit 114 as the drill bit 114 advances into the subterranean formation 102. The combination of the BHA 104 and the drill bit 114 can be referred to as a drilling tool. Fluid or "mud" from a mud tank 120, or any other suitable wellbore treatment fluid, may be pumped downhole using a mud pump 122 powered by an adjacent power source, such as a prime mover or motor 124. The mud may be pumped from the mud tank 120, through a stand pipe 126, which feeds the mud into the drill-string 106 and conveys the same to the drill bit 114. The mud can exit one or more nozzles (not shown) arranged in the drill bit 114 and in the process cools the drill bit 114. After exiting the drill bit 114, the mud can be circulated back to the surface 110 via an annulus defined between the wellbore 118 and the drill-string 106, and hole cleaning can occur which can involve returning the drill cuttings and debris to the surface. The cuttings and mud mixture are passed through a flow line 128 and are processed such that a cleaned mud can be returned down hole through the stand pipe 126 once again.

The wellbore operation system 100 can use one or more types of wellbore fluids. The one or more types of wellbore fluids can include a wellbore drilling fluid (e.g., the mud or other wellbore drilling fluids), a wellbore completion fluid (e.g., a spacer or cleaning fluid or other wellbore completion fluids), a wellbore stimulation fluid (e.g., a proppant-based fluid or other wellbore stimulation fluids), and the like. Prior to, or substantially contemporaneous with respect to using the wellbore treatment fluids in the wellbore operation system 100, the wellbore treatment fluids can be tested. For example, the wellbore treatment fluids, or any samples thereof, can be positioned in an aging cell to make measurements about one or more properties of the wellbore treatment fluids. The one or more properties can include a fluid viscosity, a change in fluid viscosity, a thermal conductivity, a shear rate, and the like. Results from testing the wellbore treatment fluids can be used to determine whether to use the wellbore treatment fluids in respective wellbore operations. For example, if the one or more properties of the wellbore treatment fluids indicate that the wellbore treatment fluids are not suitable for the respective wellbore operations, the wellbore treatment fluids may be removed from the respective wellbore operations, may not be introduced into the respective wellbore operations, etc. In some examples, a computing device 140 can be used to determine the one or more properties of the wellbore treatment fluids.

The drilling arrangement and any sensors 109 (through the drilling arrangement or directly) may be communicatively coupled to the computing device 140. The computing device 140 may be configured to control the wellbore drilling operation, or any other wellbore operation with respect to the wellbore 118, in addition to determining the one or more properties of the wellbore treatment fluids. The computing device 140 can be deployed in a work vehicle, can be installed with the drilling arrangement, can be hand-held, can be remotely located, etc. Although one computing device is depicted in FIG. 1, in other examples, more than one computing device can be used, and together, the multiple computing devices can perform operations such as controlling the wellbore operation and other operations described herein.

The computing device 140 can be positioned below-ground, aboveground, onsite, in a vehicle, offsite, etc. The computing device 140 can include a processor interfaced with other hardware via a bus. A memory, which can include any suitable tangible (and non-transitory) computer-readable medium, such as random-access memory ("RAM"), read-only memory ("ROM"), electrically erasable and programmable read-only memory ("EEPROM"), or the like, can embody program components that configure operation of the computing device 140. In some aspects, the computing device 140 can include input/output interface components, such as a display, printer, keyboard, touch-sensitive surface, and mouse, and additional storage.

The computing device 140 can include a communication device 144. The communication device 144 can represent one or more of any components that facilitate a network connection. In some examples, the communication device 144 can be wireless and can include wireless interfaces such as IEEE 802.11, Bluetooth™, or radio interfaces for accessing cellular telephone networks (e.g., transceiver/antenna for accessing a CDMA, GSM, UMTS, or other mobile communications network). In some examples, the communication device 144 can use acoustic waves, surface waves, vibrations, optical waves, or induction, such as magnetic induction, for engaging in wireless communications. In other examples, the communication device 144 can be wired and can include interfaces such as Ethernet, USB, IEEE 1394, or a fiber optic interface. In an example with at least one other computing device, the computing device 140 can receive wired or wireless communications from the other computing device and perform one or more tasks based on the communications.

Figure 2:
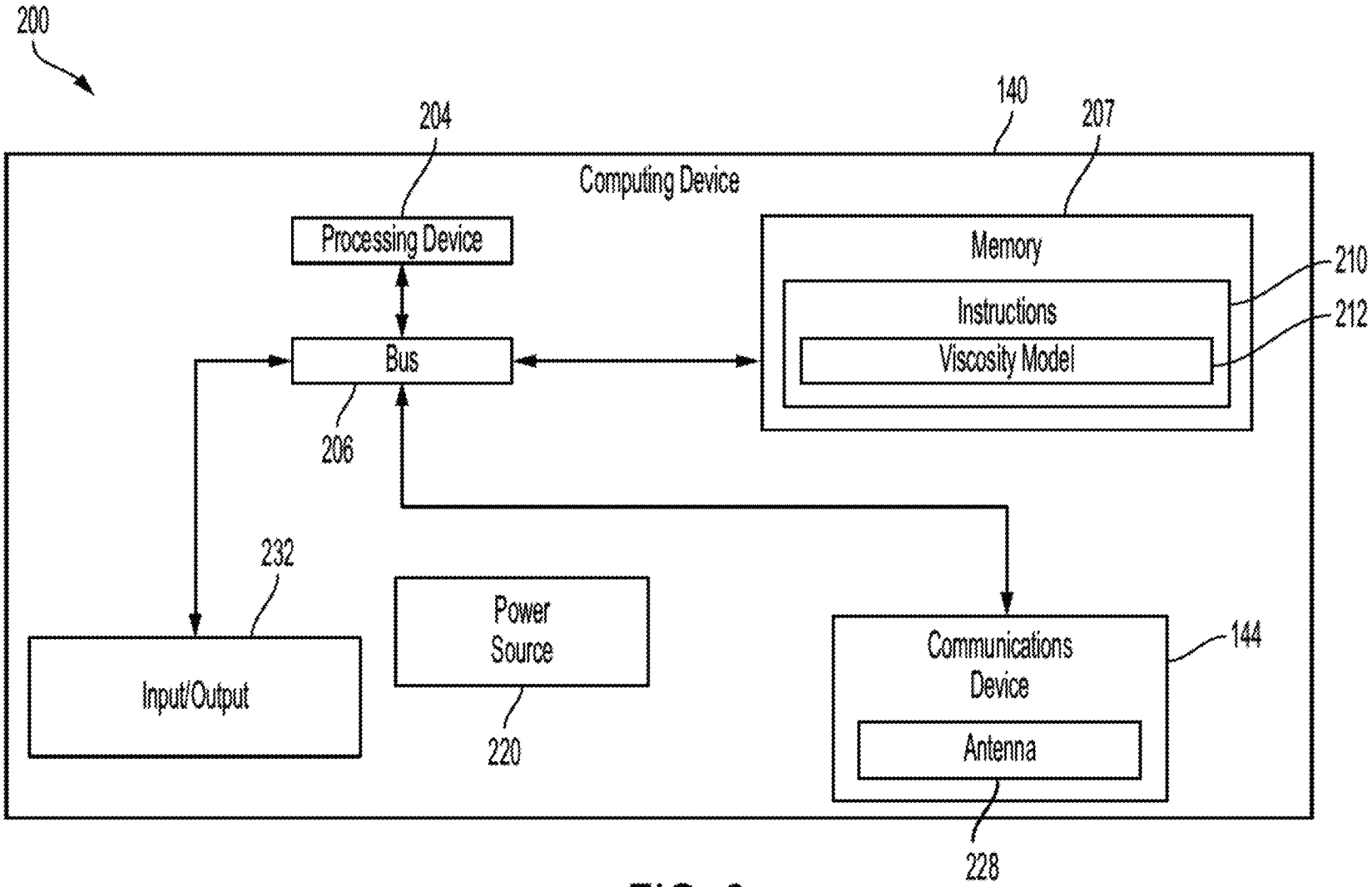
FIG. 2 is a block diagram of a computing system for determining one or more properties of a wellbore treatment fluid according to examples of the present disclosure.

FIG. 2 is a block diagram of a computing system 200 for determining one or more properties of a wellbore treatment fluid according to examples of the present disclosure. The computing system 200 can include the computing device 140. Components illustrated in FIG. 2 may be integrated into a single structure, such as in a single housing of the computing device 140. Alternatively, the components shown in FIG. 2 may be distributed from other components and in electrical communication with the other components.

The computing device 140 can include a processing device 204, a memory device 207, an input/output device 232, and a communications device 144 that can each be communicatively coupled via a bus 206. The input/output device 232 can include a display device, such as a screen or a monitor. Additionally, the input/output device 232 can include a keyboard or a mouse. A user can view data relating to outputs of a viscosity model 212, or other information that can be provided by the computing device 140, via the display device and can provide input to the computing device 140 via the input/output device 232, for example via a user interface provided by the computing device 140. In some examples, the input/output device 232 can automatically receive input, for example from one or more sensors of an aging cell, relating to a wellbore treatment fluid. The input can be used by the computing device 140 to determine one or more properties, such as viscosity, change in viscosity, thermal conductivity, shear rate, and the like, of the wellbore treatment fluid.

The processing device 204 can include one processing device or multiple processing devices. Some examples of the processing device 204 can include a field-programmable gate array (FPGA), an application-specific integrated circuit (ASIC), a micro-processing device, and the like. The processing device 204 can execute instructions 210 stored in the memory device 207 to perform operations. In some examples, the instructions 210 can include processing device-specific instructions generated by a compiler or an interpreter from code written in any suitable computer-programming language such as C, C++, C #, Java, Perl, Python, etc.

The processing device 204 can be communicatively coupled to the memory device 207 via the bus 206. The memory device 207 can include one memory or multiple memories, can be non-volatile, and may include any type of memory that can retain stored information when powered off. Some examples of the memory can include electrically erasable and programmable read-only memory (EEPROM), flash memory, or any other type of non-volatile memory. At least some of the memory can include a non-transitory computer-readable medium from which the processing device 204 can read the instructions 210. The non-transitory computer-readable medium can include electronic, optical, magnetic, or other storage devices capable of providing the processing device 204 with computer-readable instructions 210 or other program code. Some examples of the non-transitory computer-readable medium can include magnetic disk(s), memory chip(s), ROM, random-access memory (RAM), an ASIC, a configured processing device, optical storage, or any other medium from which a computer processing device can read the instructions 210.

In some examples, the memory device 207 can include instructions 210 for causing the processing device 204 to determine, based on measurements made using an aging cell, one or more properties of wellbore treatment fluid for a wellbore operation. In some examples, the processing device 204 can access the instructions 210 via the memory device 207 to execute the viscosity model 212. In some examples, the viscosity model 212 can be or include an algorithm that can determine one or more properties, such as viscosity, change in viscosity, thermal conductivity, shear rate, and the like, of the wellbore treatment fluid based on measurements or other signals received from one or more sensors positioned in the aging cell. Additionally or alternatively, the viscosity model 212 can be or include artificial intelligence, such as one or more machine-learning models, that can predict the one or more properties of the wellbore treatment fluid based on the measurements or other signals received from the one or more sensors.

The computing device 140 can include a power source 220. The power source 220 can be in electrical communication with the computing device 140 and any component thereof such as the communications device 144, the input/output device 232, and the like. In some examples, the power source 220 can include a battery or an electrical cable such as a wireline. The power source 220 can include an AC signal generator. The computing device 140 can operate the power source 220 to apply a transmission signal to the antenna 228 to generate electromagnetic waves that can convey data relating to the wellbore treatment fluid, the one or more properties thereof, etc., to other systems. For example, the computing device 140 can cause the power source 220 to apply a voltage with a frequency within a specific frequency range to the antenna 228 for causing the antenna 228 to generate a wireless transmission. In other examples, the computing device 140, rather than the power source 220, can apply the transmission signal to the antenna 228 for generating the wireless transmission.

In some examples, part of the communications device 144 can be implemented in software. For example, the communications device 144 can include additional instructions stored in the memory device 207 for controlling functions of the communication device 144. The communications device 144 can receive signals from remote devices and transmit data to remote devices. For example, the communications device 144 can transmit wireless communications that are modulated by data via the antenna 228. In some examples, the communications device 144 can receive signals, such as signals associated with data to be transmitted, from the processing device 204 and amplify, filter, modulate, frequency shift, or otherwise manipulate the signals. In some examples, the communications device 144 can transmit the manipulated signals to the antenna 228. The antenna 228 can receive the manipulated signals and can responsively generate wireless communications that carry the data.

Figure 3:
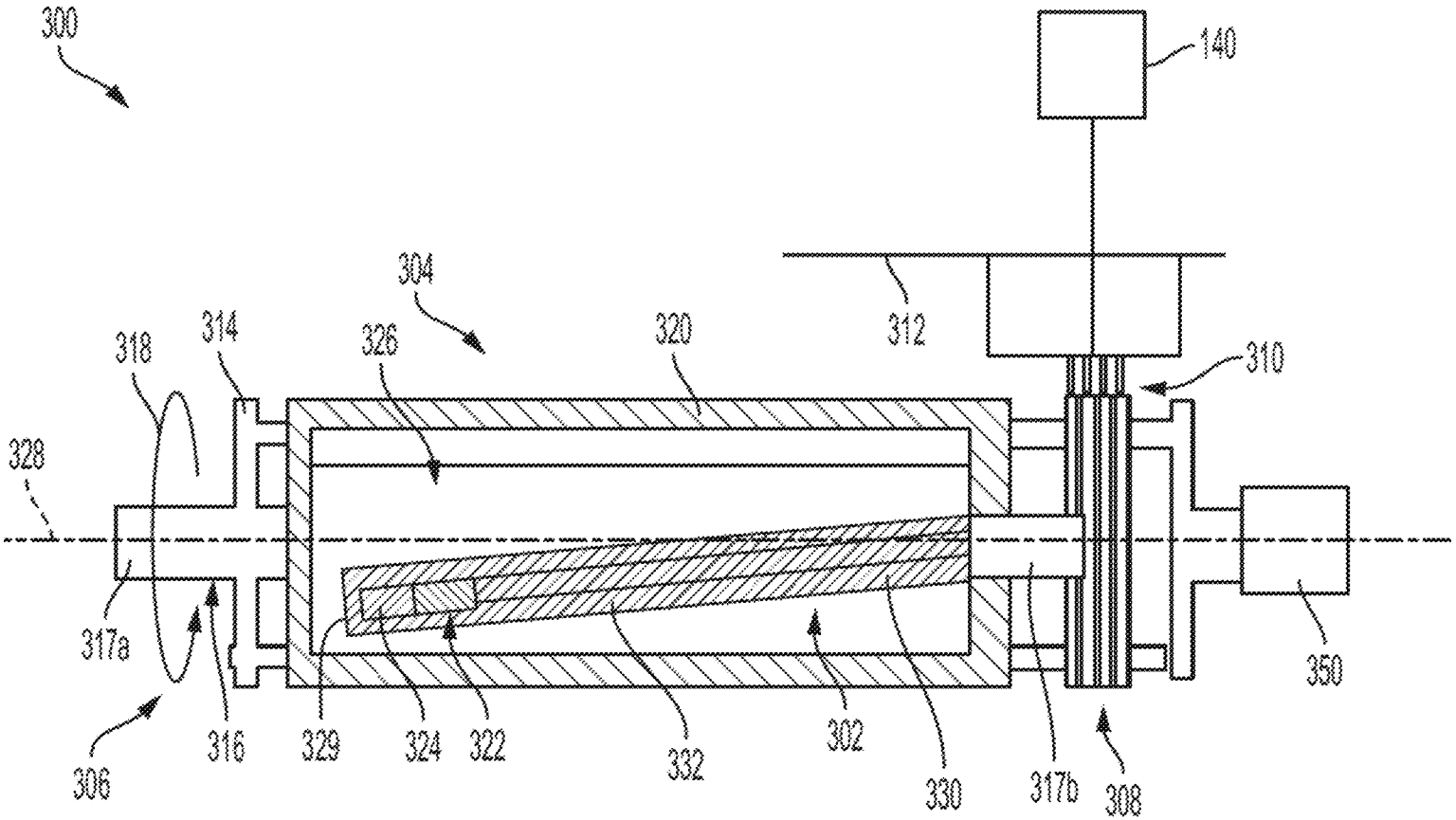
FIG. 3 is a diagram of an aging cell assembly that can be used to determine one or more properties of a wellbore treatment fluid according to examples of the present disclosure.

FIG. 3 is a diagram of an aging cell assembly 300 that can be used to determine one or more properties of a wellbore treatment fluid 302 according to examples of the present disclosure. As illustrated in FIG. 3, the aging cell assembly 300, which may be or include a roller oven with an aging cell 304, can include the aging cell 304, a rotational system 306, a coupling device 308, one or more fixed contacts 310, an access door 312 (e.g., that can be used to access or position the aging cell 304 in the aging cell assembly 300, etc.), and any other suitable component for the aging cell assembly 300. The wellbore treatment fluid 302 can be positioned in the aging cell 304 to be aged or otherwise tested. For example, the wellbore treatment fluid 302 can be aged, such as exposed to elevated heat, elevated pressure, rolling conditions, or any other conditions that the wellbore treatment fluid 302 may experience in a downhole environment, such as downhole in the wellbore 118, to determine if the wellbore treatment fluid 302 is suitable for use in one or more wellbore operations associated with the wellbore 118.

The rotational system 306 can be used to rotate the aging cell 304, the coupling device 308, and any other component of the aging cell assembly 300 that can be rotated. For example, the rotational system 306 can include a frame 314 that can attach the aging cell 304 to a shaft 316 that can be rotated, for example using a motor 350. The shaft 316 can include one or more pieces, such as pieces 317*a-b*, and can rotate in a first direction 318, which may be counterclockwise, though the shaft 316 may additionally or alternatively be rotated clockwise or in any other direction or combination of directions. Additionally, the shaft 316 can be rotated at a constant rate or at a variable rate.

The coupling device 308 may be or include a slip ring or any other suitable means or components that can be used to convey electrical signals, or other signals that can convey information, to and from the aging cell 304. For example, the coupling device 308 can include one or more wires, one or more electrical connections, or the like that can receive electrical signals, such as signals generated by a sensor, originating from an interior of the aging cell 304 and that can convey the electrical signals, and the data included therein, to a computing device. The computing device, such as the computing device 140, may be connected with a wired connection to the coupling device 308 or may be remote and connected with a wireless connection (e.g., directly or indirectly) to the coupling device 308. Additionally or alternatively, the coupling device 308 may be rotated by the rotational system 306 and may rotate similarly or identically to the aging cell 304.

The one or more fixed contacts 310 may include one or more electrical connections or other suitable means for conveying electrical signals. The one or more fixed contacts 310 can be coupled, such as in electrical or communicative connection, to the coupling device 308, to one or more computing devices, and other suitable components. In a particular example, the one or more fixed contacts 310 can be electrically connected to the coupling device 308 and to a computing device, such as the computing device 140, that can be used to control the aging process for aging the wellbore treatment fluid 302 in the aging cell 304. Additionally or alternatively, the one or more fixed contacts 310 can be mounted in the aging cell assembly 300 such that the one or more fixed contacts 310 are stationary while the aging cell 304, the rotational system 306, the coupling device 308, and the like rotate.

The aging cell 304 may be or include a pressurized vessel in which the wellbore treatment fluid 302 can be positioned. The aging cell 304 can be heated, pressurized, rolled, etc. to simulate conditions that the wellbore treatment fluid 302 may experience in a downhole environment such as downhole in the wellbore 118. Simulating the conditions that the wellbore treatment fluid 302 may experience in the downhole environment may involve or otherwise be considered "aging" the wellbore treatment fluid 302. Additionally or alternatively, aging the wellbore treatment fluid 302 may allow an operator of a wellbore operation, or other suitable entity, to detect a breakdown, such as deteriorating properties or parameters, of the wellbore treatment fluid 302. Deteriorating properties or parameters may include or be indicated by a changing viscosity of the wellbore treatment fluid 302, a changing thermal conductivity of the wellbore treatment fluid 302, etc. A breakdown of the wellbore treatment fluid 302 may indicate that the wellbore treatment fluid 302 may not be suitable for a respective wellbore operation.

In some examples, the aging cell 304 can include a housing 320, a sensor 322, a sensor shaft 324, and any other suitable components for the aging cell 304. The housing 320 can define an exterior surface of the aging cell 304, an interior region 326 of the aging cell 304, and other suitable features of the aging cell 304. In some examples, the housing 320 can be shaped as a cylinder, though the housing 320 can be shaped similarly to other suitable three-dimensional shapes such as a rectangular prism, an octagonal prism, irregular shapes, and the like that can be rotated about a rotational axis 328. The housing 320 can be made of or otherwise include materials that have a melting point that can allow aging or testing of the wellbore treatment fluid 302. For example, the housing 320 can be made of or otherwise include metallic elements (e.g., steel, aluminum, etc.) or alloys, heat-resistant polymeric materials, ceramic materials, and the like. The housing 320 can range in size from approximately 0.1 inch (0.25 cm) in diameter or width to approximately 50 inches (127 cm) or more in diameter or width.

The sensor 322 can be positioned on the sensor shaft 324 to detect information about the wellbore treatment fluid 302 or to otherwise make measurements in the aging cell 304. For example, the sensor 322 can include a thermal conductivity sensor that may include a heating element and a temperature sensor. Other suitable sensors that can detect thermal conductivity of the wellbore treatment fluid 302 can be used. The sensor 322 can be positioned on the sensor shaft 324 at one or more positions. For example, the sensor 322 can be positioned on a first end 329 of the sensor shaft 324, at a second end 330 of the sensor shaft 324, at a particular location 332 along the sensor shaft 324, or in any other suitable positions on the sensor shaft 324. Additionally, the sensor 322, or any or each of the components of the sensor 322, can be coupled, such as electrically, communicatively, etc., with the coupling device 308 to transmit electrical signals or other suitable signals detected by the sensor 322 out of the aging cell assembly 300, for example to the computing device 140.

The sensor shaft 324 can be positioned at an offset angle with respect to the rotational axis 328. The offset angle may be from approximately 0 degrees to approximately 90 degrees. The offset angle may allow the sensor shaft 324, and by extension the sensor 322, to rotate similarly or identically to the aging cell 304. For example, if the aging cell 304 is rotated by the rotational system 306 approximately 2 m/s counterclockwise (4.47 mph counterclockwise), then the sensor shaft 324 and the sensor 322 can rotate approximately 2 m/s counterclockwise (4.47 mph counterclockwise). In some examples, a rotational speed of the sensor 322, the sensor shaft 324, or a combination thereof may depend on (e.g., may vary with) the offset angle associated with the sensor shaft, the position of the sensor 322, other suitable factors, or any combination thereof.

In some examples, the rotational system 306 can rotate the aging cell 304 about the rotational axis 328. By rotating the aging cell 304, the rotational axis 328 can additionally rotate the sensor shaft 324 and the sensor 322. In some examples, the wellbore treatment fluid 302 may remain approximately in-place during rotation of the aging cell 304, and the sensor 322 may move through the wellbore treatment fluid 302. Thus, the sensor 322 can detect a temperature of multiple locations within the wellbore treatment fluid 302, can detect a thermal conductivity of multiple locations within the wellbore treatment fluid 302, and can detect other suitable signals that can be used to determine the one or more properties of the wellbore treatment fluid 302. The one or more properties of the wellbore treatment fluid 302 may include a viscosity of the wellbore treatment fluid 302, a change in the viscosity of the wellbore treatment fluid 302, a thermal conductivity of the wellbore treatment fluid 302, a shear rate of the wellbore treatment fluid 302, and other properties that can indicate whether the wellbore treatment fluid 302 is suitable for use in a respective wellbore operation.

Figure 4:
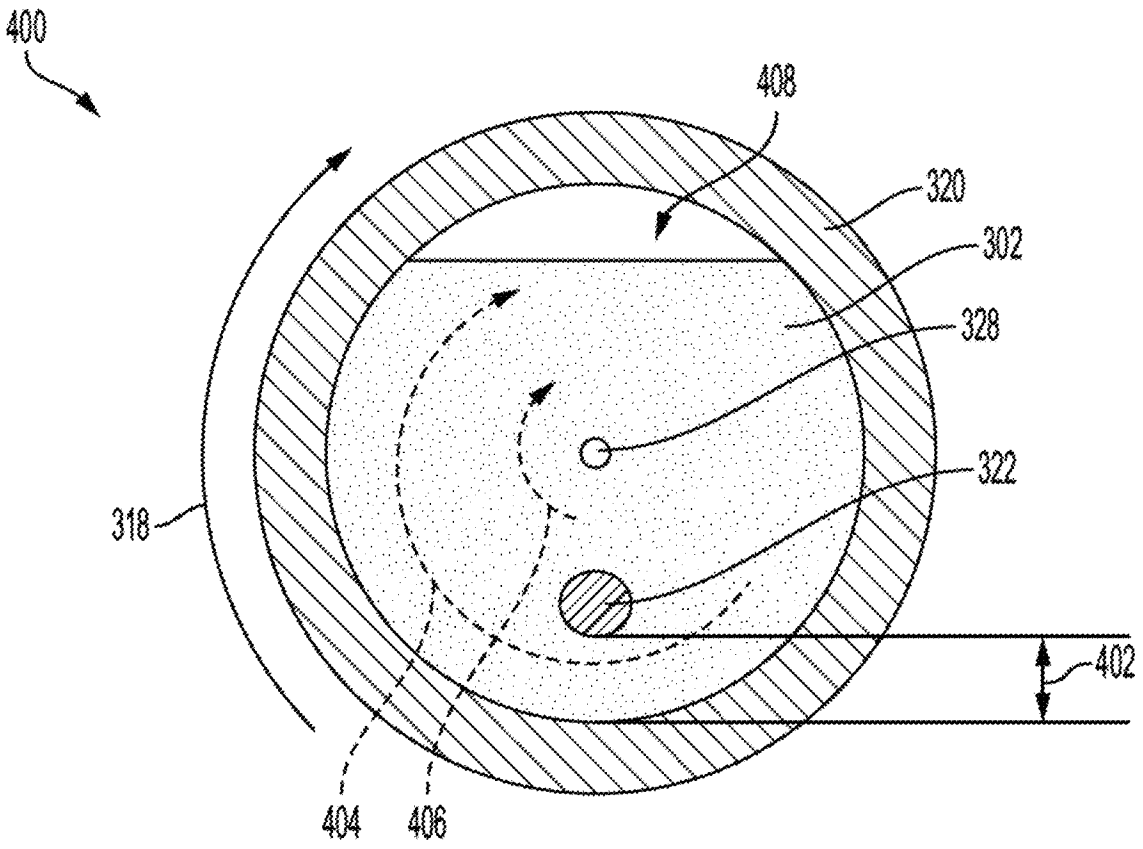
FIG. 4 is a front view of an aging cell that can be used to determine one or more properties of a wellbore treatment fluid according to examples of the present disclosure.

FIG. 4 is a front view of an aging cell 304 that can be used to determine one or more properties of a wellbore treatment fluid 302 according to examples of the present disclosure. The aging cell 304 may include the sensor shaft 324 that can be at angle from the rotational axis 328. The sensor 322 can be positioned on the sensor shaft 324 to make measurements about the wellbore treatment fluid 302 while the aging cell 304 is rotating about the rotational axis 328. Additionally, the aging cell 304 can be rotated in the first direction 318, though the aging cell 304 can be rotated in any other suitable direction.

The sensor 322 can be positioned in the aging cell 304 at a position that can be a distance 402 from an inner surface of the aging cell 304. While the aging cell 304, and by extension the sensor 322, rotates in the first direction 318, the wellbore treatment fluid 302 may traverse across or otherwise contact and move past the sensor 322 with respect to the sensor 322. The movement of the sensor 322 through the wellbore treatment fluid 302 may allow the sensor 322 to make one or more measurements, or otherwise detect signals, about the wellbore treatment fluid 302 that can be used to determine the one or more properties of the wellbore treatment fluid 302.

At the distance 402 from the inner surface of the aging cell 304, the sensor 322 may traverse path 404, which may have a first relative velocity. In other examples, the sensor may be positioned to follow path 406, which may have a second relative velocity that is less than the first relative velocity, or a second sensor may be positioned to follow the path 406. The sensor 322, the second sensor, or a combination thereof, may follow one or more of the path 404 or the path 406 through the wellbore treatment fluid 302 to make the measurements about the wellbore treatment fluid 302. The measurements may include one or more thermal conductivity measurements as the sensor 322, or the second sensor, travels through the wellbore treatment fluid 302.

In some examples, the relative speed at which the sensor 322, or the second sensor, traverses the path 404, or the path 406, may be variable. For example, the aging cell 304 may be rotated in the first direction 318 at a non-constant rate, which may cause the sensor 322 or the second sensor to travel through the wellbore treatment fluid 302 at the non-constant rate. Additionally, measurements by the sensor 322, or the second sensor, may be made at discrete locations in the aging cell 304, at discrete predetermined times, etc. For example, when the sensor 322 traverses the path 404 and is above a top level 408 of the wellbore treatment fluid 302, the sensor 322 may make a measurement, and the sensor 322 may make a subsequent measurement after traversing the path 404 back into the wellbore treatment fluid 302.

Figure 5:
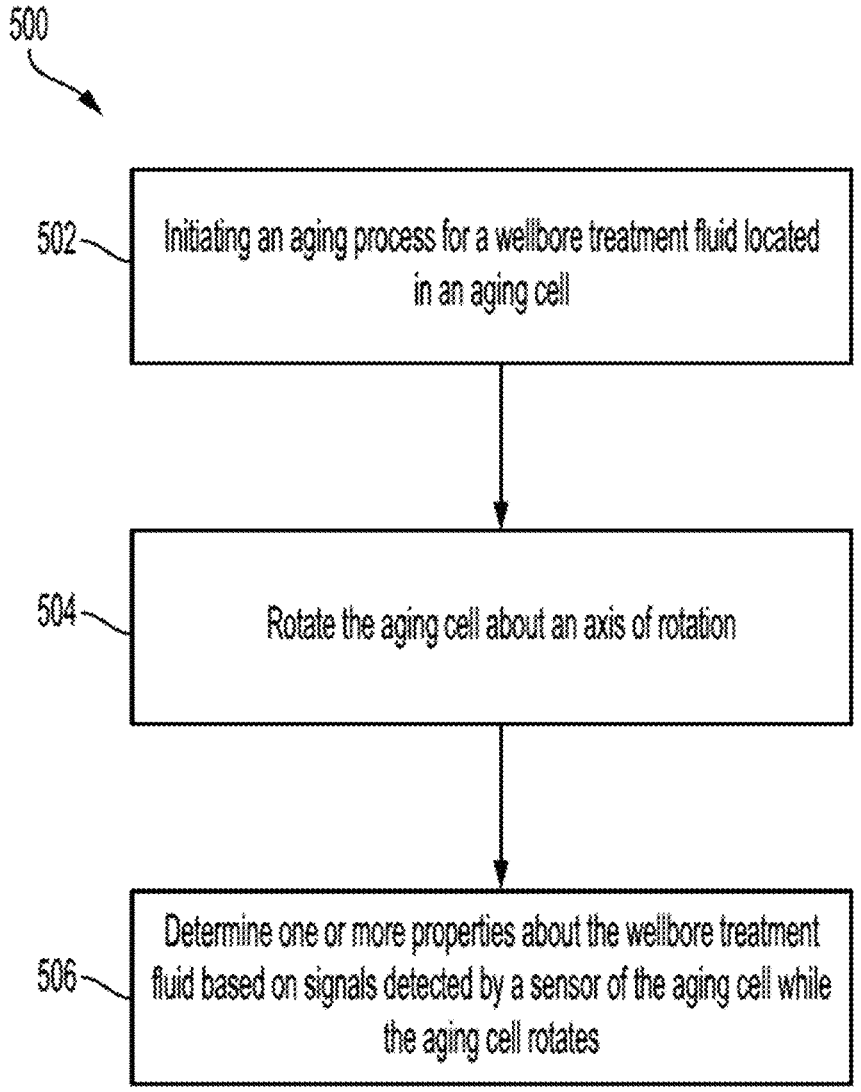
FIG. 5 is a flowchart of a process for determining one or more properties of a wellbore treatment fluid according to examples of the present disclosure.

FIG. 5 is a flowchart of a process 500 for determining one or more properties of a wellbore treatment fluid 302 according to examples of the present disclosure. At block 502, a wellbore treatment fluid 302 is positioned in an aging cell 304. The wellbore treatment fluid 302 can be used to complete or otherwise facilitate one or more wellbore operations. For example, the wellbore treatment fluid 302 can include (i) a wellbore drilling fluid for a wellbore drilling operation, (ii) a wellbore completion fluid for a wellbore completion operation, (iii) a wellbore stimulation fluid for a wellbore stimulation operation, etc. The wellbore treatment fluid 302 can be positioned in the aging cell 304 to determine one or more properties about the wellbore treatment fluid 302. For example, the aging cell 304 can be used to simulate conditions that the wellbore treatment fluid 302 may encounter downhole in the wellbore 118 during the respective wellbore operation.

The aging cell 304 may be positioned in an aging cell assembly 300 that can allow the aging cell 304 to be rotated, heated, pressurized, and the like for determining the one or more properties about the wellbore treatment fluid 302. For example, the aging cell 304 can be coupled with a rotational system 306 that can include a frame 314, a shaft 316, and other suitable components that can allow the rotational system 306 to rotate the aging cell 304 about a rotational axis 328. Additionally, the aging cell 304 can include a sensor 322 positioned on a sensor shaft 324 that is offset from the rotational axis 328. The sensor 322 may be positioned, and may include suitable components (e.g., heating element, temperature sensor, thermal conductivity sensor, etc.), to make measurements about the wellbore treatment fluid 302 while the aging cell 304 rotates about the rotational axis 328.

At block 504, the aging cell 304 is rotated about the rotational axis 328. Additionally or alternatively, the aging cell 304 can be heated, pressurized, or otherwise adjusted to simulate conditions that the wellbore treatment fluid 302 may experience downhole in the wellbore 118. Accordingly, the wellbore treatment fluid 302 can be aged in the aging cell 304, and the sensor 322 can be used to monitor the wellbore treatment fluid 302 to determine if the wellbore treatment fluid 302 encounters a breakdown during the aging process.

At block 506, one or more properties about the wellbore treatment fluid 302 can be determined. While the aging cell 304 rotates about the rotational axis 328, the sensor 322 may detect information about the wellbore treatment fluid 302 and may transit the information via signals that can be used to determine the one or more properties about the wellbore treatment fluid 302. For example, the wellbore treatment fluid 302 may traverse across the sensor 322, and the sensor 322 can heat the wellbore treatment fluid 302, can measure properties (e.g., temperature, thermal conductivity, etc.) about the wellbore treatment fluid. In some examples, the signals can be transmitted to a computing device, such as the computing device 140, to determine the one or more properties about the wellbore treatment fluid 302.

The computing device 140 can receive the signals and can execute one or more programs, such as the viscosity model 212, to determine the one or more properties about the wellbore treatment fluid 302. In some examples, the viscosity model 212 can use the signals, which may include or relate to a thermal conductivity of the wellbore treatment fluid 302 at different times during the aging process, to determine a viscosity of the wellbore treatment fluid 302, a change in the viscosity of the wellbore treatment fluid 302, a thermal conductivity of the wellbore treatment fluid 302, a shear rate of the wellbore treatment fluid 302, etc. For example, thermal conductivity may be a function of heat transfer in a static configuration, and viscosity may be a function of convective heat transfer in a dynamic flow configuration. Thus, a thermal conductivity probe placed in a dynamic flow regime can indicate a change in viscosity of the wellbore treatment fluid 302.

In some examples, the sensor 322 may be able to detect a shear rate of the wellbore treatment fluid 302, or the sensor 322 may transmit signals measured from the wellbore treatment fluid 302 to the computing device 140 to determine the shear rate of the wellbore treatment fluid 302. The shear rate of the wellbore treatment fluid 302 may be based on the viscosity, or changes in the viscosity, of the wellbore treatment fluid 302. Additionally or alternatively, changes in viscosity of the wellbore treatment fluid 302 can indicate a frequency of maintenance, a type of maintenance, or the like for the wellbore treatment fluid 302. The shear velocity of the wellbore treatment fluid 302 in the aging cell 304 (e.g., while the aging cell 304 is rotating or otherwise aging the wellbore treatment fluid 302) may change as the viscosity of the wellbore treatment fluid 302 changes. Additionally, conductive heat transfer, which can be measured by the sensor 322 in the aging cell 304, can additionally indicate changes in the viscosity of the wellbore treatment fluid 302. In some examples, the thermal conductivity may be related to a logarithmic rate of decline of temperature of the wellbore treatment fluid 302.

In some aspects, systems, methods, and aging cells for determining one or more properties of a wellbore treatment fluid are provided according to one or more of the following examples:

As used below, any reference to a series of examples is to be understood as a reference to each of those examples disjunctively (e.g., "Examples 1-4" is to be understood as "Examples 1, 2, 3, or 4").

Example 1 is a system comprising: a rotational system defining an axis of rotation; and an aging cell positionable in the rotational system to rotate about the axis of rotation, the aging cell comprising: a housing defining an interior region of the aging cell, the interior region sized to receive a wellbore treatment fluid usable in a wellbore operation; a sensor shaft coupled to the interior region to transmit electronic signals about the wellbore treatment fluid, the sensor shaft located at an offset angle with respect to the axis of rotation; and a sensor positionable on a location of the sensor shaft to detect the electronic signals while the aging cell rotates about the axis of rotation, the electronic signals usable to determine one or more properties of the wellbore treatment fluid.

Example 2 is the system of example 1, wherein the rotational system comprises: a frame sized to receive the aging cell and to enable the aging cell to rotate about the axis of rotation; and a shaft couplable to a motor to cause the rotational system to rotate about the axis of rotation, wherein the shaft extends along the axis of rotation, and wherein the shaft comprises two or more pieces.

Example 3 is the system of example 1, wherein the offset angle of the sensor shaft enables the sensor shaft to rotate about the axis of rotation, and wherein the sensor shaft is stationary with respect to the aging cell.

Example 4 is the system of example 1, wherein the sensor is positionable in the interior region of the aging cell to allow the wellbore treatment fluid to traverse, during rotation of the aging cell, across the sensor, and wherein the electronic signals are usable to determine the one or more properties of the wellbore treatment fluid are detectable by the sensor in response to the wellbore treatment fluid traversing across the sensor.

Example 5 is the system of example 1, wherein the sensor is a first sensor, wherein the aging cell further comprises a second sensor, wherein the second sensor is positionable on a second location of the sensor shaft that is different than the location of the sensor shaft, wherein second signals are detectable by the second sensor, and wherein the electronic signals and the second signals are usable to determine the one or more properties of the wellbore treatment fluid.

Example 6 is the system of example 1, further comprising: a processing device; and a non-transitory computer-readable memory device that includes instructions executable by the processing device for causing the processing device to perform operations comprising: receiving the electronic signals from the sensor; and determining the one or more properties of the wellbore treatment fluid, wherein the one or more properties comprise a viscosity of the wellbore treatment fluid, a change in the viscosity of the wellbore treatment fluid, a thermal conductivity of the wellbore treatment fluid, or a shear rate of the wellbore treatment fluid.

Example 7 is the system of any of examples 1 and 6, wherein the operations further comprise: determining, based on the one or more properties of the wellbore treatment fluid, whether the wellbore treatment fluid is suitable for use in a wellbore; and controlling a wellbore operation based on determining whether the wellbore treatment fluid is suitable for use in the wellbore.

Example 8 is a method comprising: initiating an aging process for a wellbore treatment fluid that is positioned in an aging cell, the aging cell comprising: a housing defining an interior region of the aging cell, the interior region sized to receive the wellbore treatment fluid to be used in a wellbore operation; a sensor shaft coupled to the interior region of the aging cell to transmit electronic signals about the wellbore treatment fluid, the sensor shaft located at an offset angle with respect to an axis of rotation; and a sensor positioned on a location of the sensor shaft to detect the electronic signals while the aging cell rotates about the axis of rotation; rotating the aging cell about the axis of rotation; and determining one or more properties about the wellbore treatment fluid using the electronic signals detected by the sensor.

Example 9 is the method of example 8, wherein the aging cell is coupled to a rotational system that comprises (i) a frame sized to receive the aging cell and to enable the aging cell to rotate about the axis of rotation, and (ii) a shaft couplable to a motor, and wherein rotating the aging cell comprises using the motor to rotate the rotational system about the axis of rotation, wherein the shaft extends along the axis of rotation, and wherein the shaft comprises two or more pieces.

Example 10 is the method of example 8, wherein the offset angle of the sensor shaft enables the sensor shaft to rotate about the axis of rotation, and wherein the sensor shaft is stationary with respect to the aging cell.

Example 11 is the method of example 8, wherein the sensor is positioned in the interior region of the aging cell, wherein during rotation of the aging cell, the wellbore treatment fluid traverses across the sensor, and wherein the electronic signals are used to determine the one or more properties of the wellbore treatment fluid are detected by the sensor in response to the wellbore treatment fluid traversing across the sensor.

Example 12 is the method of example 8, wherein the sensor is a first sensor, wherein the aging cell further comprises a second sensor, wherein the second sensor is positioned on a second location of the sensor shaft that is different than the location of the sensor shaft, wherein second signals are detected by the second sensor while the aging cell rotates about the axis of rotation, and wherein the electronic signals and the second signals are used to determine the one or more properties of the wellbore treatment fluid.

Example 13 is the method of example 8, wherein the aging cell is communicatively coupled with a computing device comprising: a processing device; and a non-transitory computer-readable memory device that includes instructions executable by the processing device for causing the processing device to perform operations comprising: receiving the electronic signals from the sensor; and determining the one or more properties of the wellbore treatment fluid, wherein the one or more properties comprise a viscosity of the wellbore treatment fluid, a change in the viscosity of the wellbore treatment fluid, a thermal conductivity of the wellbore treatment fluid, or a shear rate of the wellbore treatment fluid.

Example 14 is the method of any of examples 8 and 13, wherein the operations further comprise: determining, based on the one or more properties of the wellbore treatment fluid, whether the wellbore treatment fluid is suitable for use in the wellbore; and controlling a wellbore operation based on determining whether the wellbore treatment fluid is suitable for use in the wellbore.

Example 15 is an aging cell comprising: a housing defining an interior region of the aging cell, the interior region sized to receive a wellbore treatment fluid usable in a wellbore operation; a sensor shaft coupled to the interior region to transmit electronic signals about the wellbore treatment fluid, the sensor shaft located at an offset angle with respect to an axis of rotation defined by a rotational system in which the aging cell is disposed; and a sensor positionable on a location of the sensor shaft to detect the electronic signals while the aging cell rotates about the axis of rotation, the electronic signals usable to determine one or more properties of the wellbore treatment fluid.

Example 16 is the aging cell of example 15, wherein the rotational system comprises: a frame sized to receive the aging cell and to enable the aging cell to rotate about the axis of rotation; and a shaft couplable to a motor to cause the rotational system to rotate about the axis of rotation, wherein the shaft extends along the axis of rotation, and wherein the shaft comprises two or more pieces.

Example 17 is the aging cell of example 15, wherein the offset angle of the sensor shaft enables the sensor shaft to rotate about the axis of rotation, and wherein the sensor shaft is stationary with respect to the aging cell.

Example 18 is the aging cell of example 15, wherein the sensor is located in the interior region of the aging cell, wherein during rotation of the aging cell, the wellbore treatment fluid traverses across the sensor, and wherein the electronic signals are usable to determine the one or more properties of the wellbore treatment fluid are detectable by the sensor in response to the wellbore treatment fluid traversing across the sensor.

Example 19 is the aging cell of example 15, wherein the sensor is a first sensor, wherein the aging cell further comprises a second sensor, wherein the second sensor is positionable on a second location of the sensor shaft that is different than the location of the sensor shaft, wherein second signals are detectable by the second sensor, and wherein the electronic signals and the second signals are usable to determine the one or more properties of the wellbore treatment fluid.

Example 20 is the aging cell of example 15, wherein the aging cell is communicatively coupled with a computing device comprising: a processing device; and a non-transitory computer-readable memory device that includes instructions executable by the processing device for causing the processing device to perform operations comprising: receiving the electronic signals from the sensor; and determining the one or more properties of the wellbore treatment fluid, wherein the one or more properties comprise a viscosity of the wellbore treatment fluid, a change in the viscosity of the wellbore treatment fluid, a thermal conductivity of the wellbore treatment fluid, or a shear rate of the wellbore treatment fluid; determining, based on the one or more properties of the wellbore treatment fluid, whether the wellbore treatment fluid is suitable for use in the wellbore; and controlling a wellbore operation based on determining whether the wellbore treatment fluid is suitable for use in the wellbore.

The foregoing description of certain examples, including illustrated examples, has been presented only for the purpose of illustration and description and is not intended to be exhaustive or to limit the disclosure to the precise forms disclosed. Numerous modifications, adaptations, and uses thereof will be apparent to those skilled in the art without departing from the scope of the disclosure.

What is claimed is:

1. A system comprising:

a rotational system defining an axis of rotation; and an aging cell positionable in the rotational system to rotate about the axis of rotation, the aging cell comprising:

a housing defining an interior region of the aging cell, the interior region sized to receive a wellbore treatment fluid usable in a wellbore operation;

a sensor shaft coupled to the interior region to transmit electronic signals about the wellbore treatment fluid, the sensor shaft located at an offset angle with respect to the axis of rotation; and a sensor positionable on a location of the sensor shaft to detect the electronic signals while the aging cell rotates about the axis of rotation, the electronic signals usable to determine one or more properties of the wellbore treatment fluid.

2. The system of claim 1, wherein the rotational system comprises:

a frame sized to receive the aging cell and to enable the aging cell to rotate about the axis of rotation; and a shaft couplable to a motor to cause the rotational system to rotate about the axis of rotation, wherein the shaft extends along the axis of rotation, and wherein the shaft comprises two or more pieces.

3. The system of claim 1, wherein the offset angle of the sensor shaft enables the sensor shaft to rotate about the axis of rotation, and wherein the sensor shaft is stationary with respect to the aging cell.

4. The system of claim 1, wherein the sensor is positionable in the interior region of the aging cell to allow the wellbore treatment fluid to traverse, during rotation of the aging cell, across the sensor, and wherein the electronic signals are usable to determine the one or more properties of the wellbore treatment fluid are detectable by the sensor in response to the wellbore treatment fluid traversing across the sensor.

5. The system of claim 1, wherein the sensor is a first sensor, wherein the aging cell further comprises a second sensor, wherein the second sensor is positionable on a second location of the sensor shaft that is different than the location of the sensor shaft, wherein second signals are detectable by the second sensor, and wherein the electronic signals and the second signals are usable to determine the one or more properties of the wellbore treatment fluid.

6. The system of claim 1, further comprising:

a processing device; and a non-transitory computer-readable memory device that includes instructions executable by the processing device for causing the processing device to perform operations comprising:

receiving the electronic signals from the sensor; and determining the one or more properties of the wellbore treatment fluid, wherein the one or more properties comprise a viscosity of the wellbore treatment fluid, a change in the viscosity of the wellbore treatment fluid, a thermal conductivity of the wellbore treatment fluid, or a shear rate of the wellbore treatment fluid.

7. The system of claim 6, wherein the operations further comprise:

determining, based on the one or more properties of the wellbore treatment fluid, whether the wellbore treatment fluid is suitable for use in a wellbore; and controlling a wellbore operation based on determining whether the wellbore treatment fluid is suitable for use in the wellbore.

8. A method comprising:

initiating an aging process for a wellbore treatment fluid that is positioned in an aging cell, the aging cell comprising:

a housing defining an interior region of the aging cell, the interior region sized to receive the wellbore treatment fluid to be used in a wellbore operation;

a sensor shaft coupled to the interior region of the aging cell to transmit electronic signals about the wellbore treatment fluid, the sensor shaft located at an offset angle with respect to an axis of rotation; and a sensor positioned on a location of the sensor shaft to detect the electronic signals while the aging cell rotates about the axis of rotation;

rotating the aging cell about the axis of rotation; and determining one or more properties about the wellbore treatment fluid using the electronic signals detected by the sensor.

9. The method of claim 8, wherein the aging cell is coupled to a rotational system that comprises (i) a frame sized to receive the aging cell and to enable the aging cell to rotate about the axis of rotation, and (ii) a shaft couplable to a motor, and wherein rotating the aging cell comprises using the motor to rotate the rotational system about the axis of rotation, wherein the shaft extends along the axis of rotation, and wherein the shaft comprises two or more pieces.

10. The method of claim 8, wherein the offset angle of the sensor shaft enables the sensor shaft to rotate about the axis of rotation, and wherein the sensor shaft is stationary with respect to the aging cell.

11. The method of claim 8, wherein the sensor is positioned in the interior region of the aging cell, wherein during rotation of the aging cell, the wellbore treatment fluid traverses across the sensor, and wherein the electronic signals are used to determine the one or more properties of the wellbore treatment fluid detected by the sensor in response to the wellbore treatment fluid traversing across the sensor.

12. The method of claim 8, wherein the sensor is a first sensor, wherein the aging cell further comprises a second sensor, wherein the second sensor is positioned on a second location of the sensor shaft that is different than the location of the sensor shaft, wherein second signals are detected by the second sensor while the aging cell rotates about the axis of rotation, and wherein the electronic signals and the second signals are used to determine the one or more properties of the wellbore treatment fluid.

13. The method of claim 8, wherein the aging cell is communicatively coupled with a computing device comprising:

a processing device; and a non-transitory computer-readable memory device that includes instructions executable by the processing device for causing the processing device to perform operations comprising:

receiving the electronic signals from the sensor; and determining the one or more properties of the wellbore treatment fluid, wherein the one or more properties comprise a viscosity of the wellbore treatment fluid, a change in the viscosity of the wellbore treatment fluid, a thermal conductivity of the wellbore treatment fluid, or a shear rate of the wellbore treatment fluid.

14. The method of claim 13, wherein the operations further comprise:

determining, based on the one or more properties of the wellbore treatment fluid, whether the wellbore treatment fluid is suitable for use in the wellbore; and controlling a wellbore operation based on determining whether the wellbore treatment fluid is suitable for use in the wellbore.

15. An aging cell comprising:

a housing defining an interior region of the aging cell, the interior region sized to receive a wellbore treatment fluid usable in a wellbore operation;

a sensor shaft coupled to the interior region to transmit electronic signals about the wellbore treatment fluid, the sensor shaft located at an offset angle with respect to an axis of rotation defined by a rotational system in which the aging cell is disposed; and a sensor positionable on a location of the sensor shaft to detect the electronic signals while the aging cell rotates about the axis of rotation, the electronic signals usable to determine one or more properties of the wellbore treatment fluid.

16. The aging cell of claim 15, wherein the rotational system comprises:

a frame sized to receive the aging cell and to enable the aging cell to rotate about the axis of rotation; and a shaft couplable to a motor to cause the rotational system to rotate about the axis of rotation, wherein the shaft extends along the axis of rotation, and wherein the shaft comprises two or more pieces.

17. The aging cell of claim 15, wherein the offset angle of the sensor shaft enables the sensor shaft to rotate about the axis of rotation, and wherein the sensor shaft is stationary with respect to the aging cell.

18. The aging cell of claim 15, wherein the sensor is located in the interior region of the aging cell, wherein during rotation of the aging cell, the wellbore treatment fluid traverses across the sensor, and wherein the electronic signals are usable to determine the one or more properties of the wellbore treatment fluid detectable by the sensor in response to the wellbore treatment fluid traversing across the sensor.

19. The aging cell of claim 15, wherein the sensor is a first sensor, wherein the aging cell further comprises a second sensor, wherein the second sensor is positionable on a second location of the sensor shaft that is different than the location of the sensor shaft, wherein second signals are detectable by the second sensor, and wherein the electronic signals and the second signals are usable to determine the one or more properties of the wellbore treatment fluid.

20. The aging cell of claim 15, wherein the aging cell is communicatively coupled with a computing device comprising:

a processing device; and a non-transitory computer-readable memory device that includes instructions executable by the processing device for causing the processing device to perform operations comprising:

receiving the electronic signals from the sensor; and determining the one or more properties of the wellbore treatment fluid, wherein the one or more properties comprise a viscosity of the wellbore treatment fluid, a change in the viscosity of the wellbore treatment fluid, a thermal conductivity of the wellbore treatment fluid, or a shear rate of the wellbore treatment fluid;

determining, based on the one or more properties of the wellbore treatment fluid, whether the wellbore treatment fluid is suitable for use in the wellbore; and controlling a wellbore operation based on determining whether the wellbore treatment fluid is suitable for use in the wellbore.

* * * * *